US005434042A

United States Patent [19]

Fujiwara

[11] Patent Number: 5,434,042

[45] Date of Patent: Jul. 18, 1995

[54] SILVER HALIDE PHOTOGRAPHIC MATERIAL

[75] Inventor: Toshiki Fujiwara, Kanagawa, Japan

[73] Assignee: Fuji Photo Film Co., Ltd., Kanagawa, Japan

[21] Appl. No.: 358,675

[22] Filed: Dec. 19, 1994

Related U.S. Application Data

[63] Continuation of Ser. No. 127,992, Sep. 28, 1993, abandoned.

[30] Foreign Application Priority Data

Sep. 30, 1992 [JP] Japan ..... 4-261282

[51] Int. Cl.[6] ..... G03C 1/18

[52] U.S. Cl. ..... 430/583; 430/585; 430/600; 430/601; 430/603; 430/605

[58] Field of Search ..... 430/583, 585, 575, 600, 430/601, 603, 605

[56] References Cited

U.S. PATENT DOCUMENTS 2,066,966 1/1937 Dieterle et al. ..... 430/583
5,236,821 8/1992 Yagihara et al. ..... 430/600

FOREIGN PATENT DOCUMENTS 405309 1/1934 United Kingdom .
411876 6/1934 United Kingdom .

*Primary Examiner*—Thorl Chea
*Attorney, Agent, or Firm*—Sughrue, Mion, Zinn, Macpeak & Seas

[57] ABSTRACT

A silver halide photographic material contains light-sensitive silver halide grains which are contained contained in a silver halide emulsion layer and which have been selenium sensitized. The silver halide emulsion layer also contains at least one compound represented by the following formula (I):

(I)

The variables in the formula are defined in the specification.

5 Claims, No Drawings

SILVER HALIDE PHOTOGRAPHIC MATERIAL

This is a Continuation of Application No. 08/127,992 filed Sep. 28, 1993, now abandoned.

FIELD OF THE INVENTION

The present invention relates to a silver halide photographic material, and more particularly to a silver halide photographic material improved in residual coloration and high in sensitivity.

BACKGROUND OF THE INVENTION

Developments in the field of electronics have led to demands in many fields for rapidity, and the field of silver halide photographic processing is no exception.

In particular, the necessity for rapid processing has increased more and more with respect to sheet-type photographic materials such as photographic materials for graphic arts, photographic materials for X-rays, photographic materials for scanners and photographic materials for CRT image recording.

The faster that processing becomes, the smaller the tank capacity that is required for processing a photographic material per unit of area per unit of time. Namely, it provides the advantage of minimizing the size of the automatic developing apparatus. Rapid processing is therefore important.

However, rapid processing aggravates the problem of coloration remaining in a silver halide photographic material (so-called residual coloration) caused by incomplete elution during processing of a sensitizing dye contained in the photographic material.

Previously, sensitizing dyes having hydrophilic substituents such as a sulfamoyl group and a carbamoyl group have been studied to reduce the residual coloration (for example, JP-A-1-147451 (the term "JP-A" as used herein means an "unexamined published Japanese patent application"), JP-A-61-294429, JP-B-45-32749 (the term "JP-B" as used herein means an "examined Japanese patent publication"), JP-A-61-77843, U.S. Pat. Nos. 3,282,933 and 5,091,298, and European Patents 467,370A1 and 472,004A1). However, an enhanced hydrophilic property generally results in lowered absorbability, so that it is difficult to obtain satisfactory sensitivity. Addition of the sensitizing dyes in an increased amount to obtain sufficient sensitivity causes unsatisfactory residual coloration. It is also observed that the sensitizing dyes described in European Patents 446,845A2 and 451,816A1 have the effect of reducing residual coloration. However, these dyes offer insufficient compatibility between reduced residual coloration and satisfactory sensitivity as described above.

SUMMARY OF THE INVENTION

It is therefore an object of the present invention to provide a silver halide photographic material having sensitivity compatible with reduced residual coloration.

This and other objects of the present invention are achieved by a silver halide photographic material comprising a support and at least one silver halide emulsion layer formed thereon. The light-sensitive silver halide grains contained in the silver halide emulsion layer have been selenium sensitized, and the silver halide emulsion layer comprises at least one compound represented by the following formula (I):

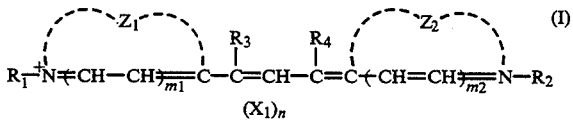

(I)

Further, as an agent for selenium sensitization, a compound represented by the following formula (II) is preferably used:

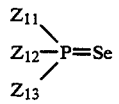

(II)

In formula (I), $Z_1$ and $Z_2$ each represents a nonmetallic atom or atoms necessary for forming a 5- or 6-membered nitrogen-containing heterocycle which may be condensed; $R_1$ and $R_2$, which may be the same or different, each represents an alkyl group; $R_3$ and $R_4$ each represents a hydrogen atom, an alkyl group or an aryl group, and at least one of $R_3$ and $R_4$ is an alkyl group or an aryl group; $X_1$ represents an ion pair sufficient to neutralize the charge of the compound; $m_1$ and $m_2$ each represents 0 or 1; and n represents 0 or 1, and n is 0 when an internal salt is formed.

In formula (II), $Z_{11}$, $Z_{12}$ and $Z_{13}$, which may be the same or different, each represents an alkyl group, an aryl group, a heterocyclic group, a halogen atom, a hydrogen atom, $—OR_{11}$, $—NR_{12}(R_{13})$, $—SR_{14}$ or $—SeR_{15}$; wherein $R_{11}$, $R_{14}$ and $R_{15}$ each represents an alkyl group, an aryl group, a heterocyclic group, a hydrogen atom or a cation; and $R_{12}$ and $R_{13}$ each represents an alkyl group, an aryi group, a heterocyclic group or a hydrogen atom.

DETAILED DESCRIPTION OF THE INVENTION

The methine compounds represented by formula (I) are described in detail below.

The 5- or 6-membered nitrogen-containing heterocycles formed by $Z_1$ or $Z_2$ include a thiazole nucleus (for example, thiazole, 4-methylthiazole, 4-phenylthiazole, 4,5-dimethylthiazole and 4,5-diphenylthiazole); a benzthiazole nucleus (for example, benzthiazole, 4-chlorobenzthiazole, 5-chlorobenzthiazole, 6-chlorobenzthiazole, 5-nitrobenzthiazole, 4-methylbenzthiazole, 5-methylbenzthiazole, 6-methylbenzthiazole, 5-bromobenzthiazole, 6-bromobenzthiazole, 5-iodobenzthiazole, 5-phenylbenzthiazole, 5-methoxybenzthiazole, 6-methoxybenzthiazole, 5-ethoxybenzthiazole, 5-ethoxycarbonylbenzthiazole, 5-carboxybenzthiazole, 5-phenethylbenzthiazole, 5-fluorobenzthiazole, 5-chloro-6-methylbenzthiazole, 5,6-dimethylbenzthiazole, 5-hydroxy-6-methylbenzthiazole, tetrahydrobenzthiazole, 4-phenylbenzthiazole); a naphthothiazole nucleus (for example, naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole); a thiazoline nucleus (for example, thiazoline, 4-methylthiazoline, 4-nitrothiazoline); an oxazole nucleus (for example, oxazole, 4-methyloxazole, 4-nitroxazole, 5-methyloxazole, 4-phenyloxazole, 4,5-diphenyloxazole, 4-ethyloxazole); a benzoxazole nucleus (for example, benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, 5-ethoxybenzoxazole ); a naphthoxazole nucleus (for example, naphtho[2,1-d ]oxazole, naphtho[1,2-d]oxazole, naphtho[2,3-d]oxazole, 5-nitronaphtho[2,1-d]oxazole); an oxazoline nucleus (for example, 4,4-dimethyloxazoline); a selenazole nucleus (for example, 4-methylselenazole, 4-nitroselenazole, 4-phenylselenazole); a benzoselenazole nucleus (for example, benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole); a naphthoselenazole nucleus (for example, naphtho[2,1-d]selenazole and naphtho[1,2-d]selenazole); a 3,3-dialkylindolenine nucleus (for example, 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine, 3,3,5-trimethylindolenine, 3,3-dimethyl-5-chloroindolenine); an imidazole nucleus (for example, a 1-alkylimidazole, a 1-alkyl-4-phenylimidazole, a 1-alkylbenzimidazole, a 1-alkyl-5-chlorobenzimidazole, a 1-alkyl-5,6-dichlorobenzimidazole, a 1-alkyl-5-methoxybenzimidazole, a 1-alkyl-5-cyanobenzimidazole, a 1-alkyl-5-fluorobenzimidazole, a 1-alkyl-5-trifluoromethylbenzimidazole, a 1-alkyl-6-chloro-5-cyanobenzimidazole, a 1-alkyl-6-chloro-5-trifluoromethylbenzimidazole, a 1-alkylnaphtho[1,2-d]imidazole, a 1-allyl-5,6-dichlorobenzimidazole, a 1-allyl-5-chlorobenzimidazole, a 1-arylimidazole, a 1-arylbenzimidazole, a 1-aryl-5-chlorobenzimidazole, a 1-aryl-5,6-dichlorobenzimidazole, a 1-aryl-5-methoxybenzimidazole, a 1-aryl-5-cyanobenzimidazole and a 1-arylnaphtho[1,2-d]imidazole, wherein the alkyl is preferably an alkyl group having from 1 to 8 carbon atoms, for example, an unsubstituted alkyl group such as methyl, ethyl, propyl, isopropyl and butyl, or a hydroxyalkyl group such as 2-hydroxyethyl and 3-hydroxypropyl, and more preferably methyl or ethyl, and the aryl is phenyl, halogen-substituted phenyl such as chloro-substituted phenyl, alkyl-substituted phenyl such as methyl-substituted phenyl or alkoxy-substituted phenyl such as methoxy-substituted phenyl); a pyridine nucleus (for example, 2-pyridine, 4-pyridine, 5-methyl-2-pyridine, 3-methyl-4-pyridine); a quinoline nucleus (for example, 2-quinoline, 2-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, isoquinoline, 6-nitro-l-isoquinoline, 3,4-dihydro-1-isoquinoline, 6-nitro-3-isoquinoline); an imidazo[4,5b]quinoxaline nucleus (for example, 1,3-diethylimidazo[4,5-b]quinoxaline and 6-chloro-l,3-diallylimidazo[4,5b]quinoxaline); a benzotellurazole nucleus (for example, benzotellurazole, 5-methylbenzotellurazole and 5-methoxybenzotellurazole); a naphthotellurazole nucleus (for example, naphtho[1,2-d]-tellurazole); an oxadiazole nucleus; a thiadiazole nucleus; a tetrazole nucleus; and a pyrimidine nucleus.

Of these heterocyclic nuclei, the thiazole, benzothiazole, naphthothiazole, oxazole, benzoxazole, naphthoxazole, benzimidazole, naphthoimidazole and quinoline nuclei are preferred, and the benzoxazole nucleus is most preferred.

Examples of the alkyl groups represented by $R_1$ and $R_2$, which may be substituted, include an alkyl group having generally from 1 to 18 carbon atoms, preferably from 1 to 7 carbon atoms, more preferably from 1 to 4 carbon atoms, such as an unsubstituted alkyl group (for example, methyl, ethyl, propyl, isopropyl, butyl, isobutyl, hexyl, octyl, dodecyl, octadecyl); a substituted alkyl group such as an aralkyl group (for example, benzyl, 2-phenylethyl); a hydroxyalkyl group (for example, 2-hydroxyethyl, 3-hydroxypropyl ); a group (for example, 2-carboxyethyl, 3carboxyalkyl carboxypropyl, 4-carboxybutyl, carboxymethyl ); an group (for example, 2-methoxyethyl, 2-(2-alkoxyalkyl methoxyethoxy)-ethyl); a sulfoalkyl group (for example, 2-sulfoethyl, 3-sulfopropyl, 3-sulfobutyl, 4-sulfobutyl, 4-sulfo-3-methylbutyl, 2-(3-sulfopropoxy)ethyl, 2-hydroxy-3-sulfopropyl, 3-sulfopropoxyethoxyethyl); sulfatoalkyl group (for example, 3-sulfatopropyl, 4 -sulfatobutyl); a heterocycle-substituted alkyl group for example, 2-(pyrrolidine-2-one-1-yl)ethyl, tetrahydrofurfuryl); 2-acetoxyethyl; carbomethoxymethyl; 2-methanesulfonylaminoethyl; and allyl.

It is preferred that each of the alkyl groups represented by $R_1$ and $R_2$ has from 1 to 5 carbon atoms, and methyl, ethyl, 2-sulfoethyl, 3-sulfopropyl, 4-sulfobutyl and 3-sulfobutyl groups are particularly preferred.

Each of the alkyl groups and the aryl groups represented by $R_3$ and $R_4$, which may be substituted, has from 1 to 18 carbon atoms, preferably 1 to 7 carbon atoms, and more preferably 1 to 4 carbon atoms. Examples of the alkyl group include an unsubstituted alkyl group (for example, methyl, ethyl, propyl, isopropyl, butyl, isobutyl, hexyl, octyl, dodecyl, octadecyl); and a substituted alkyl group (for example, an aralkyl group such as benzyl and 2-phenylethyl, a hydroxyalkyl group such as 2-hydroxyethyl and 3-hydroxypropyl, a carboxyalkyl group such as 2-carboxyethyl, 3-carboxypropyl, 4-carboxybutyl and carboxymethyl, an alkoxyalkyl group such as 2-methoxyethyl and 2-(2-methoxyethoxy)ethyl, a sulfoalkyl group such as 2-sulfoethyl, 3-sulfopropyl, 3-sulfobutyl, 4-sulfobutyl, 2-(3-sulfopropoxy)ethyl, 2-hydroxy-3-sulfopropyl and 3-sulfopropoxyethoxyethyl, a sulfatoalkyl group such as 3-sulfatopropyl and 4-sulfatobutyl, a heterocyclesubstituted alkyl group such as 2-(pyrrolidine-2-one-1-yl)ethyl, tetrahydrofurfuryl and 2-morpholinoethyl, a 2-acetoxyethyl group, a carbomethoxymethyl group, a 2-methanesulfonylaminoethyl group and an allyl group. Examples of the aryl group include an unsubstituted aryl group such as phenyl and 2-naphthyl, and a substituted aryl group such as 4-carboxyphenyl, 4-sulfophenyl, 3-chlorophenyl and 3-methylphenyl.

Preferred as $R_3$ and $R_4$ are a methyl group, an ethyl group and a phenyl group.

$X_1$ represents an ion pair sufficient to neutralize the charge of the compound. Examples of cations include a hydrogen ion, a sodium ion, a potassium ion, a triethylammonium ion and a pyridinium ion, and examples of anions include a chlorine atom, a bromine atom, an iodine atom, a p-toluenesulfonate, a p-nitrobenzenesulfonate, a methanesulfonate, a methylsulfate, an ethylsulfate, a perchlorate and a 1,5-naphthalenedisulfonate.

n represents 1 or 0, and when an internal salt is formed, n is 0.

$m_1$ and $m_2$ each represents 0 or 1.

The methine compounds represented by formula (I) can be synthesized, based on the methods described in G.B. Patent 405,309, F.M. Hamer, *Heterocyclic Compounds-Cyanine Dyes and Related Compounds* (John Wiley & Sons, New York, London, 1964); D.M. Sturmer, *Heterocyclic Compounds-Special Topics in Heterocyclic Chemistry*, chapter 18, section 14, pages 482 to 515 (John Wiley & Sons, New York, London, 1977); *Rodd's Chemistry of Carbon Compounds*, 2nd ed., vol. IV, part B, chapter 15, pages 369 to 422 (Elsvier Science Publishing Company Inc., New York, 1977); and ibid. 2nd ed., vol. IV, part B, chapter 15, pages 267 to 269 (1985).

Formula (II) is hereinafter described in more detail.

In formula (II), the alkyl groups represented by $Z_{11}$, $Z_{12}$, $Z_{13}$, $R_{11}$, $R_{12}$, $R_{13}$, $R_{14}$ and $R_{15}$ include a straight-chain or cyclic alkyl group, an alkenyl group, an alkynyl group and an aralkyl group. Specific examples of these groups include methyl, ethyl, n-propyl, isopropyl, t-butyl, n-butyl, n-octyl, n-decyl, n-hexadecyl, cyclopentyl, cyclohexyl, allyl, 2-butenyl, 3-pentenyl, propargyl, 3-pentynyl, benzyl and phenethyl.

The aryl groups represented by $Z_{11}$, $Z_{12}$, $Z_{13}$, $R_{11}$, $R_{12}$, $R_{13}$, $R_{14}$ and $R_{15}$ include monocyclic or cyclocondensed aryl groups such as phenyl, pentafluorophenyl, 4-chlorophenyl, 3-sulfophenyl, 1-naphthyl and 4-methylphenyl.

The heterocyclic groups represented by $Z_{11}$, $Z_{12}$, $Z_{13}$, $R_{11}$, $R_{12}$, $R_{13}$, $R_{14}$ and $R_{15}$ include 3- to 10-membered, saturated or unsaturated heterocyclic groups having at least one of a nitrogen atom, an oxygen atom and a sulfur atom (for, example, pyridyl, thienyl, thiazolyl, imidazolyl and benzylimidazolyl).

The cations represented by $R_{11}$, $R_{14}$ and $R_{15}$ in formula (II) include alkali metal atoms and ammonium, and the halogen atoms include, for example, fluorine, chlorine, bromine and iodine.

It is preferred that $Z_{11}$, $Z_{12}$ and $Z_{13}$ each represents a straight-chain or cyclic alkyl group or a monocyclic or cyclocondensed aryl group.

More preferably, the compound represented by formula (II) is a trialkylphosphine selenide, a triarylphosphine selenide, a trialkyl selenophosphate or a triaryl selenophosphate.

Typical examples of the compounds represented by formulae (I) and (II) are shown below, but they are not intended to limit the scope of the invention.

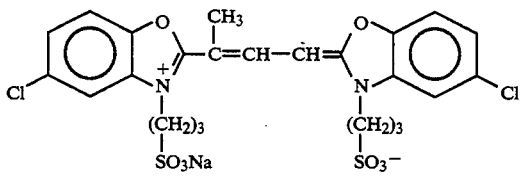
(I-1)

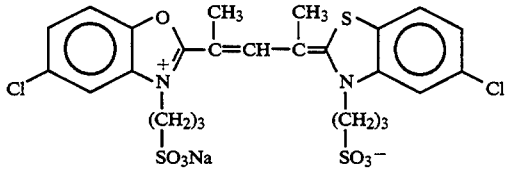
(I-2)

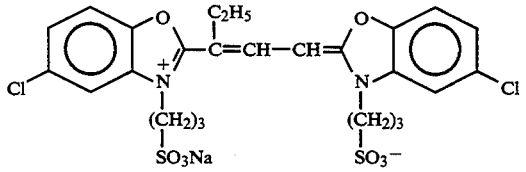
(I-3)

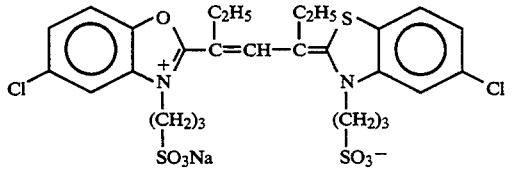
(I-4)

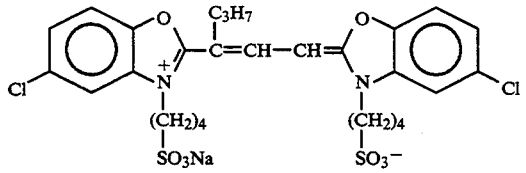
(I-5)

-continued
(I-6)
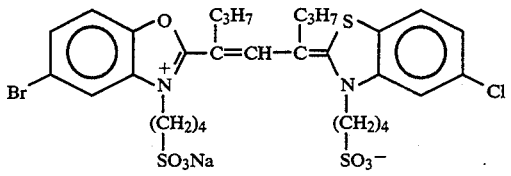
(I-7)
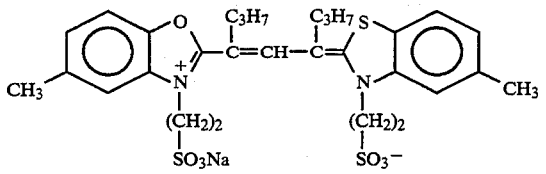
(I-8)
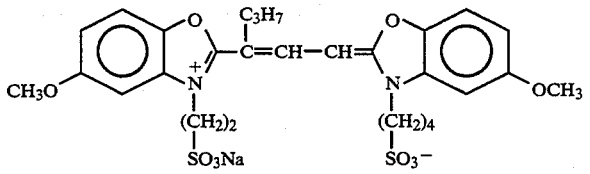
(I-9)
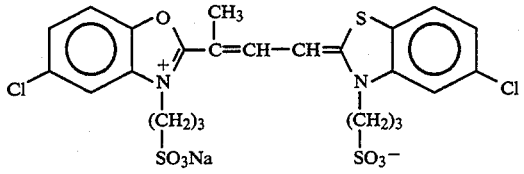
(I-10)
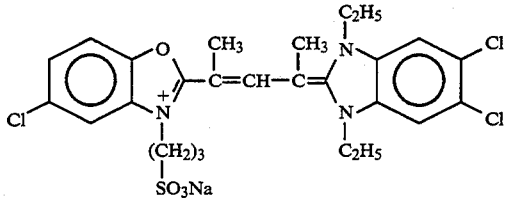
(I-11)
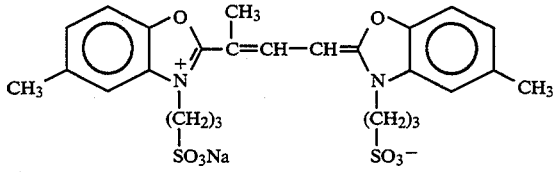
(I-12)
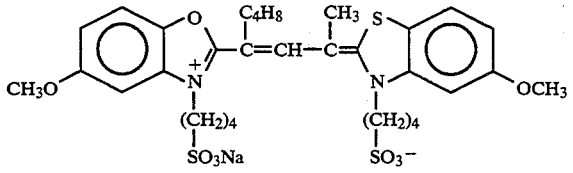
(I-13)
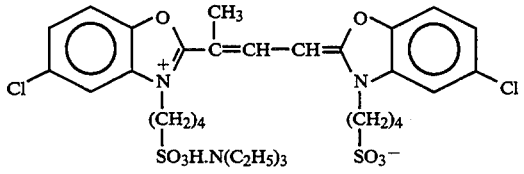

-continued
(I-14)
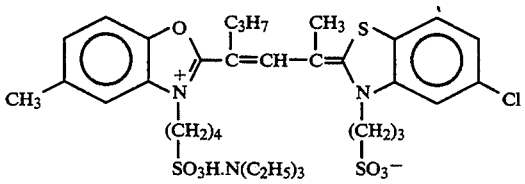
(I-15)
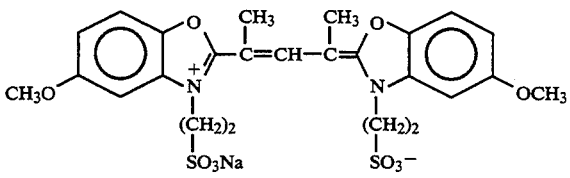
(I-16)
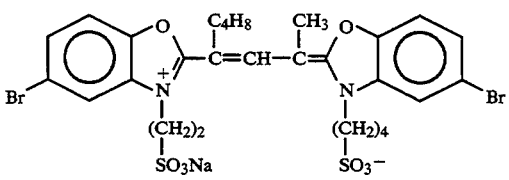
(I-17)
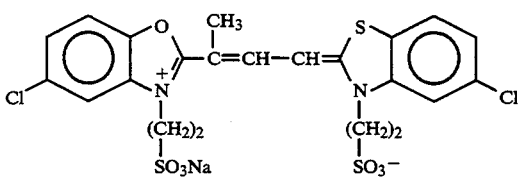
(I-18)
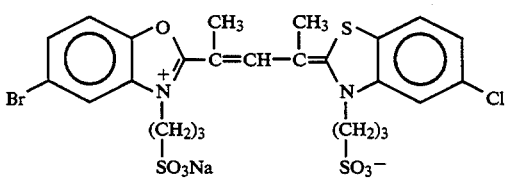
(I-19)
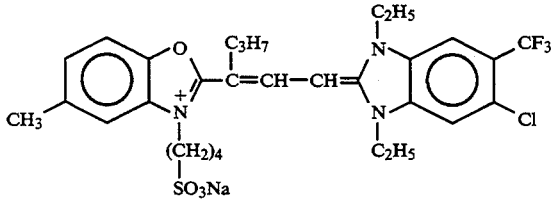
(I-20)
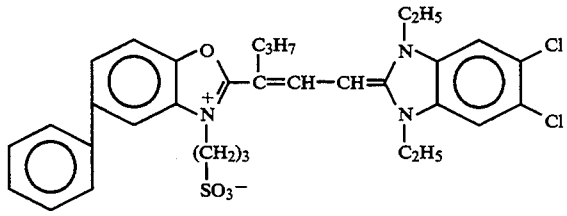
(I-21)
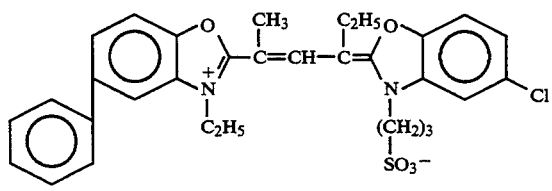

-continued
(I-22)
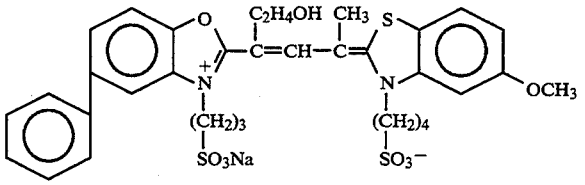
(I-23)
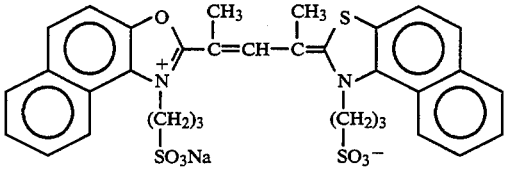
(I-24)
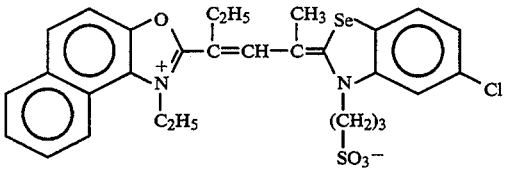
(I-25)
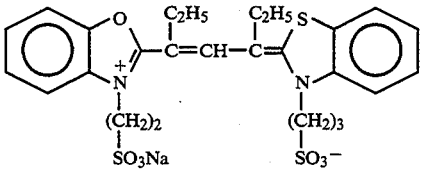
(I-26)
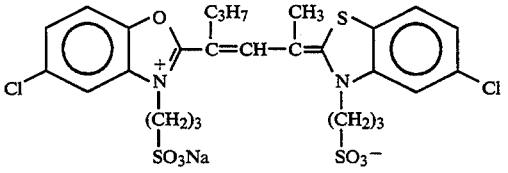
(I-27)
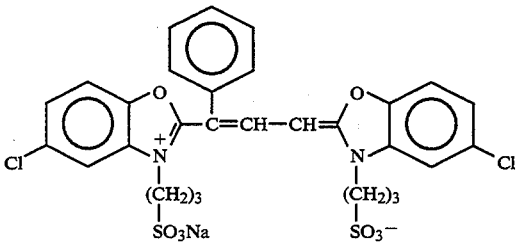
(I-28)
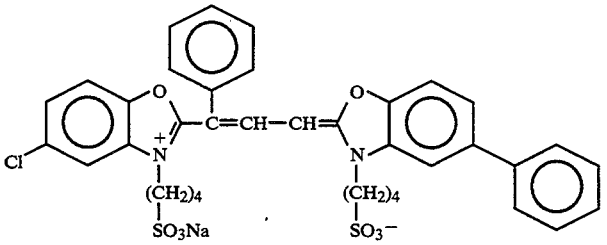

-continued
(I-29)
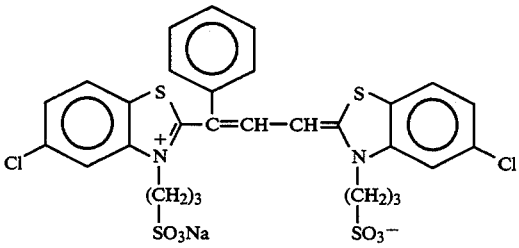
(I-30)
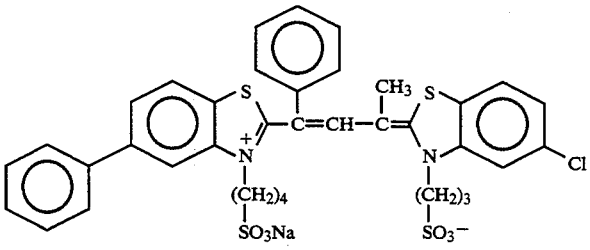
(I-31)
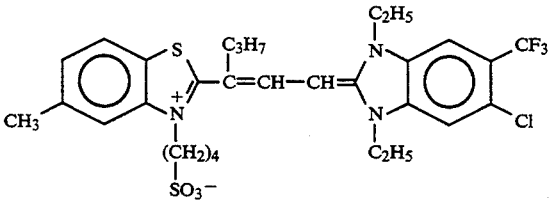
(I-32)
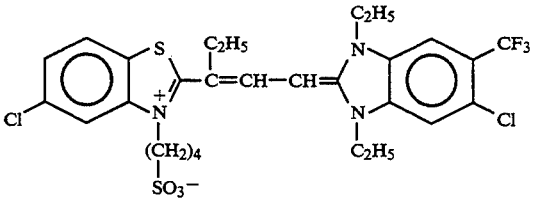
(II-1)
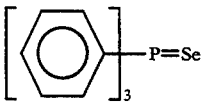
(II-2)
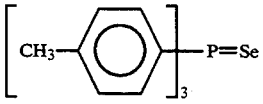
(II-3)
$(nC_4H_9)_3P{=}Se$
(II-4)
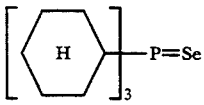
(II-5)
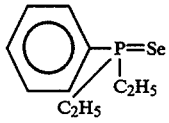
(II-6)
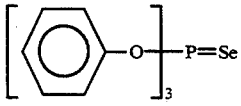

-continued
(II-7)
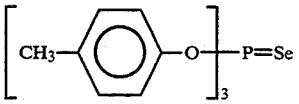
(II-8)
$(nC_4H_9O)_3P{=}Se$
(II-9)
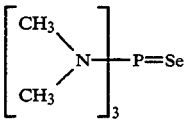
(II-10)
$(C_2H_5O)_3P{=}Se$
(II-11)
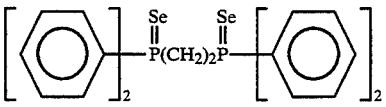
(II-12)
$(nC_8H_{17})_3P{=}Se$
(II-13)
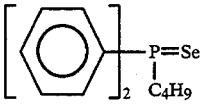
(II-14)
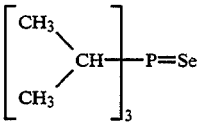
(II-15)
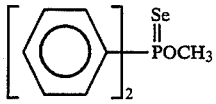
(II-16)
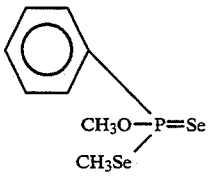
(II-17)
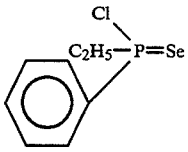
(II-18)
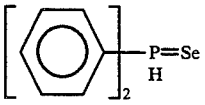
(II-19)
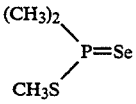
(II-20)
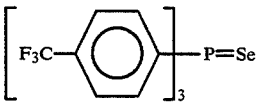

-continued (II-21)

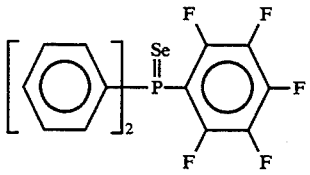

Silver halide emulsions used in silver halide photographic materials are usually subjected to chemical sensitization by use of various chemical substances to obtain desired sensitivity and gradation. As typical sensitizing processes, various processes such as sulfur sensitization, selenium sensitization, noble metal sensitization (for example, gold sensitization), reduction sensitization and combinations thereof are known.

Selenium sensitizers which can be used in the present invention include the selenium compounds described in U.S. Pat. Nos. 1,574,944, 1,602,592, 1,623,499, 3,297,446, 3,297,447, 3,320,069, 3,408,169, 3,408,197, 3,442,653, 3,420,670 and 3,591,385, French Patents 2,693,038 and 2,093,209, JP-B-52-34491, JP-B-52-34492, JP-B-53-295, JP-B-57-22090, JP-A-59-180536, JP-A-59-185330, JP-A-59-181337, JP-A-59-187338, JP-A-59-192241, JP-A-60-150046, JP-A-60-151637, JP-A-61-246738, British Patents 255,846 and 861,984 and H.E. Spencer et al., *Journal of Photographic Science,* 31, 158–169 (1983). In particular, unstable selenium compounds which can react with silver nitrate in aqueous solutions to form a precipitate of silver selenide are used. For example, the selenium compounds described in U.S. Pat. Nos. 1,574,944, 1,602,592, 1,623,499 and 3,297,446 are preferred. More specifically, the selenium compounds include colloidal metallic selenium; isoselenocyantes (for example, allyl isoselenocyanate); selenourea derivatives ( for example, selenourea; aliphatic selenourea derivatives such as N,N-dimethylselenourea and N,N-diethylselenourea; and substituted selenourea derivatives having aromatic groups such as phenyi or heterocyclic groups such as pyridyl); selenoketones (for example, selenoacetone and selenoacetophenone); selenoamides (for example, selenoacetamide); selenocarboxylic acids and esters thereof (for example, 2-selenopropionic acid and methyl 3-selenobutylate); selenides (for example, diethyl selenide and triphenylphosphine selenide); and selenophosphates (for example, uri-p-tolyl selenophosphate).

The amount of the selenium sensitizer used varies depending on the kind of selenium compounds and silver halide grains used and the conditions of chemical ripening. But it is generally $10^{-8}$ to $10^{-4}$ mol/mol of silver halide, preferably $10^{-7}$ to $10^{-5}$ mol/mol of silver halide. The selenium sensitizers are preferably added after grain formation and further desalination.

The conditions of chemical ripening using the selenium sensitizer are not particularly limited in the present invention. However, the pAg is generally 6 to 11, preferably 7 to 10, and more preferably 7 to 9.55. The temperature is 40° to 95° C., preferably 50° to 85° C.

in the present invention, it is preferred to use the selenium sensitizers in combination with noble metal sensitizers such as gold, platinum, palladium and iridium sensitizers. In particular, the gold sensitizers are preferably used in combination. Specific examples thereof include chloroauric acid, potassium chloroaurate, potassium aurithiocyanate, gold sulfide and gold selenide. The gold sensitizers can be used in an amount of $10^{-7}$ to $10^{-2}$ mol/mol of silver halide.

Further, it is also preferred to use the selenium sensitizers in combination with sulfur sensitizers in this invention. Specific examples thereof include conventional unstable sulfur compounds such as thiosulfates (for example, hypo), thiourea derivatives (for example, diphenylthiourea, triethylthiourea and allylthiourea) and rhodanine compounds. They can be used in an amount of $10^{-7}$ to $10^{-2}$ mol/mol of silver halide.

Furthermore, in the present invention, it is also possible to use reduction sensitizers in combination. Specific examples thereof include stannous chloride, aminoiminomethanesulfinic acid, hydrazine derivatives, borane compounds, silane compounds and polyamine compounds.

Moreover, in the present invention, it is preferred to conduct selenium sensitization in the presence of solvents for silver halides.

Specific examples of such solvents include thiocyanates (for example, potassium thiocyanate), thioether compounds ( for example, compounds described in U.S. Patents 3,021,215 and 3,271,157, JP-B-58-30571 and JP-A-60-136736, particularly 3,6-dithio-1,8-octanediol), tetra-substituted thiourea compounds (for example, compounds described in JP-B-59-11892 and U.S. Pat. No. 4,221,863, particularly tetramethylthiourea), thione compounds described in JP-B-60-11341, mercapto compounds described in JP-B-63-29727, mesoionic compounds described in JP-A-60-163042, selenoether compounds described in U.S. Pat. No. 4,782,013, telluroether compounds described in JP-A-2-118566 and sulfites. Of these compounds, particularly, the thiocyanates, the thioether compounds, the tetra-substituted thiourea compounds and the thione compounds can be preferably used. These compounds can be used in an amount of about $10^{-5}$ to $10^{-2}$ mol/mol of silver halide.

The silver halide emulsions preferably subjected to selenium sensitization according to the present invention include silver bromide, silver iodobromide, silver iodochlorobromide, silver chlorobromide and silver chloride.

The silver halide grains subjected to selenium sensitization according to the present invention may have a regular crystal form such as a cubic, an octahedral or a tetradecahedral form, an irregular crystal form such as a spherical or a plate (tabular) form, or a composite form thereof. Further, mixtures of grains having various crystal forms may also be used. It is however preferred that the grains having a regular crystal form are used.

The silver halide grains subjected to selenium sensitization according to the present invention may have different phases in the interior and the surface layers, respectively, or may have homogeneous phases. Further, the grains on the surfaces of which latent images are mainly formed (for example, negative type emulsions) may be used, or the grains in the interiors of which latent images are mainly formed (for example, internal latent image type emulsions or previously fogged direct reversal type emulsions) may be used. Preferably, the grains on the surfaces of which latent images are mainly formed are used.

The silver halide emulsions used in the present invention are preferably tabular grain emulsions which contain grains having a thickness of 0.5 μm or less, preferably 0.3 μm or less, and a diameter of preferably 0.6 μm or more, and in which 50% or more of all grains as a projected area are composed of grains having a mean aspect ratio of at least 3, or monodisperse emulsions having a statistical coefficient of variation (the value S/d obtained by dividing the standard deviation S by the diameter d in distribution of grains when the grain diameter is represented by the diameter of circles approximated by the projected area of the grains) of 20% or less. In addition, at least two kinds of tabular grain emulsions and monodisperse emulsions may be mixed.

The photographic emulsions used in the present invention can be prepared according to the methods described in P. Glafkides, *Chimie et Physique Photograghique* (Paul Montel, 1967), G.F. Duffin, *Photographic Emulsion Chemistry* (Focal Press, 1966) and V.L. Zelikman et al., *Making and Coating Photographic Emulsion* (Focal Press, 1964).

In forming the silver halide grain emulsions, solvents for silver halides are used to control the growth of the grains. Examples of such solvents include ammonia, potassium rhodanide, ammonium rhodanide and thioether compounds (for example, compounds described in U.S. Pat. Nos. 3,271,157, 3,574,628, 3,704,130, 4,297,439 and 4,276,374), thione compounds (for example, compounds described in JP-A-53-144319, JP-A-53-82408 and JP-A-55-77737) and amine compounds (for example, compounds described in JP-A-54-100717).

Cadmium salts, zinc salts, thallium salts, iridium salts or complex salts thereof, rhodium salts or complex salts thereof, iron salts or complex salts thereof may be allowed to coexist in the course of formation of the silver halide grains or during physical ripening.

When silver iodobromide or silver iodochlorobromide is used, the emulsions used in the photographic materials of the present invention preferably have a relative standard deviation of the silver iodide content of the respective silver halide grains in the emulsions of 20% or more for the respective emulsions. The above-described relative standard deviation exceeding 20% unfavorably results in a tendency to increase fogging and deteriorate gradation.

The silver iodide content of the respective grains can be measured by the methods described in JP-A-2-256043 (corresponding to Japanese Patent Application Nos. 63-325383 and 1-045724).

The silver halide photographic emulsions which can be used in combination in the photographic materials of the present invention can be prepared, for example, by use of the methods described in *Research Disclosure* (RD), No. 17643, pages 22 to 23, "I. Emulsion Preparation and Types" (December 1978), ibid. No. 18716, page 648 (November 1979), P. Glafkides, *Chimie et Physique Photographique* (Paul Montel, 1967), G.F. Duffin, *Photographic Emulsion Chemistry* (Focal Press, 1966) and V.L. Zelikman et al., *Making and Coating Photographic Emulsion* (Focal Press, 1964).

Monodisperse emulsions described in U.S. Pat. Nos. 3,574,628 and 3,655,394 and British Patent 1,413,748 are also preferably used.

The silver halide grains used in the present invention may be either homogeneous in crystal structure or heterogeneous in silver halide composition in the inside and the outside of the grains. Further, the grains may have a layer structure. Furthermore, silver halides different in composition may be connected to each other by epitaxial growth, or silver halides may be connected to compounds other than the silver halides, such as rhodanic acid and lead oxide.

In addition, mixtures of grains of various crystal forms may be used.

There is no particular limitation on various additives, etc., used for the photographic materials of the present invention. For example, those described in the corresponding portions shown below can be preferably used, in addition to those described above.

| Item | Corresponding Portion |
|---|---|
| 1) Silver Halide Emulsions and Preparations Thereof | JP-A-2-68539, page 8, lower right column, line 6 from the bottom to page 10, upper right column, line 12; JP-A-3-24537, page 2, lower right column, line 10 to page 6, upper right column, line 1, page 10, left upper column, line 16 to page 11, lower left column, line 19; JP-A-4-107442 |
| 2) Chemical Sensitization | JP-A-2-68539, page 10, upper right column, line 13 to upper left column, line 16; Japanese Patent Application No. 3-105035 |
| 3) Antifoggants and Stabilizers | JP-A-2-68539, page 10, lower left column, line 17 to page 11, upper left column, line 7, page 3, lower left column, line 2 to page 4, lower left column |
| 4) Color Tone Improvers | JP-A-62-276539, page 2, lower left column, line 7 to page 10, lower left column, line 20; JP-A-3-94249, page 6, lower left column, line 15 to page 11, upper right column, line 19 |
| 5) Color Sensitizing Dyes | JP-A-2-68539, page 4, lower right column, line 4 to page 8, lower right column |
| 6) Surface Active Agents and Antistatic Agents | JP-A-2-68539, page 11, upper left column, line 14 to page 12, upper left column, line 9 |
| 7) Matting Agents, Lubricants and Plasticizers | JP-A-2-68539, page 12, upper left column, line 10 to upper right column, line 10, page 14, lower left column, line 10 to lower right column, line 1 |
| 8) Hydrophilic Colloids | JP-A-68539, page 12, upper right column, line 11 to lower left column, line 16 |
| 9) Hardeners | JP-A-2-68539, page 12, upper right column, line 17 to page 13, upper right column, line 6 |
| 10) Supports | JP-A-2-68539, page 13, upper right column, line 7 to line 20 |
| 11) Crossover Cut Methods | JP-A-2-264944, page 4, upper right column, line 20 to page 14, upper right column |
| 12) Dyes and Mordants | JP-A-2-68539, page 13, lower left column, line 1 to page 14, lower left |

-continued

| Item | Corresponding Portion |
|---|---|
| | column, line 9; JP-A-3-24539, page 3.4, lower left column to page 16, lower right column |
| 13) Polyhydroxybenzenes | JP-A-3-39948, page 11, upper left column to page 12, lower left column; European Patent Publication No. 452772 |
| 14) Layer Constitution | JP-A-3-198041 |
| 15) Processing Methods | JP-A-2-103037, page 16, upper right column, line 7 to page 19, lower left column, line 15; JP-A-2-115837, page 3, lower right column, line 5 to page 6, upper right column, line 10 |

In the present invention, combinations of dihydroxybenzene compounds and 1-phenyl-3-pyrazolidone compounds are employed as developing agents used in developing solutions so that good performance can be easily obtained, but the developing agents may further contain p-aminophenol compounds, of course, in addition to them.

Further, ascorbic acid compounds may be used in place of hydroquinone compounds.

The dihydroxybenzene developing agents used in the present invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone and 2,5-dimethylhydroquinone. In particular, hydroquinone is preferred. The developing agents are preferably used in an amount of 0.001 to 1.2 mol/liter of developing solution.

The 1-phenyl-3-pyrazolidone auxiliary developing agents used in the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone and 1-p-aminophenyl-4,4-dimethyl-3-pyrazolidone.

In the present invention, the 1-phenyl-3-pyrazolidone auxiliary developing agents are used in an amount of 0.06 mol/liter of developing solution or more, and preferably in an amount of 0.07 to 0.12 mol/liter of developing solution.

Sulfite preservatives used in development include sodium sulfite, potassium sulfite, lithium sulfite, ammonium sulfite, sodium bisulfite and potassium metabisulfite. It is preferred that the sulfites are in an amount of 0.2 mol/liter of developing solution or more, and particularly in an amount of 0.4 mol/liter of developing solution or more. The upper limit thereof is preferably 2.5 mol/liter of developing solution.

The pH of the developing solutions used in the present invention preferably is generally from 8.5 to 13, preferably from 9 to 12.

Alkali agents used for pH adjustment include pH regulators such as sodium hydroxide, potassium hydroxide, sodium carbonate, potassium carbonate, sodium tertiary phosphate and potassium tertiary phosphate.

Buffers such as the borates described in JP-A-62-186259, the compounds (for example, saccharose, acetoxime and 5-sulfosalicylic acid) described in JP-A-60-93433, phosphates and carbonates may also be used.

Further, it is preferred to use hardeners in the above-described developing agents.

As the hardeners, dialdehyde hardeners or bisulfite adducts thereof are preferably used. Illustrative of these are glutaraldehyde and bisulfite adducts thereof.

Additives which may be used in addition to the above-described components include development inhibitors such as sodium bromide, potassium bromide and potassium iodide; organic solvents such as ethylene glycol, diethylene glycol, triethylene glycol, dimethylformamide, methyl cellosolve, hexylene glycol, ethanol and methanol; antifoggants such as mercapto compounds (e.g., sodium 1-phenyl-5-mercaptotetrazole, 2-mercaptobenzimidazole-5-sulfonate), indazole compounds (e.g., 5-nitroindazole) and benztriazole compounds (e.g., 5-methylbenztriazole)o The developing solutions may also contain the development accelerators described in *Research Disclosure,* 176, No. 17643, page XXI (December, 1978), and further toning agents, surface active agents, antifoaming agents, water softeners, and amino compounds described in JA-P-56-106244 as desired.

In the present invention, silver stain inhibitors such as the compounds described in JP-A-56-24347 can be used in the developing solutions.

Further, amino compounds such as alkanolamines described in JP-A-56-106244 and European Patent Publication No. 0136582 can be used in the developing solutions.

A fixing solution is an aqueous solution containing a thiosulfate as a fixing agent and has a pH of 3.8 or more, preferably 4.0 to 7.0, and more preferably 4.2 to 5.5.

The fixing agents include sodium thiosulfate and ammonium thiosulfate, and ammonium thiosulfate is particularly preferred in terms of the rate of fixing. The amount of the fixing agent used can be properly varied and is generally from 0.1 to 3 mol/liter of fixing solution.

The fixing agents may contain aqueous aluminum salts acting as hardeners. Examples thereof include aluminum chloride, aluminum sulfate and potassium alum.

Tartaric acid, citric acid, gluconic acid and derivatives thereof can be used alone or in combination in the fixing solutions. These compounds are effectively contained in an amount of at least 0.005 mol/liter of fixing solution, and more effectively in an amount of 0.01 to 0.03 mol/liter of fixing solution.

The fixing solutions can contain preservatives (for example, sulfites and bisulfites), pH buffers (for example, acetic acid and boric acid), pH regulators (for example, sulfuric acid), chelating agents having softening ability and the compounds described in JP-A-62-78551 as so desired.

The concept of washing water used in the present invention includes not only washing water of a restricted sense, but also a so-called stabilizing solution.

Tap water, ion-exchanged water, and distilled water can be used as the washing water. The washing water may also be subjected to the following antifungal treatment, in addition to contact with fur inhibitors.

The applicable antifungal treatment include an ultraviolet irradiation method described in JP-A-60-263939, a method using a magnetic field described in JP-A-60-263940, a method using an ion-exchange resin to obtain pure water described in JP-A-61-131632, and the methods using microbiocides described in JP-A-62-115154, JP-A-62-153952 and JP-A-62-209532.

Further, the microbiocides, antifungal agents, surface active agents, etc. described in L.F. West, "Water Quality Criteria", *Photo Sci & Eng,* 9, No 6 (1965), M.W. Beach, "Microbiological Growths in Motion-Picture Processing", *SMPTE Journal,* 85 (1976), R.O. Deegan, "Photo Processing Wash Water Biocides", *J. Imag. Tech.,* 10, No. 6 (1984), JP-A-57-8542, JP-A-57-58143, JP-A-58-105145, JP-A-57-132146, JP-A-58-18631, JP-A-57-97530 and JP-A-57-157244 can also be used in combination as desired.

Furthermore, the isothiazoline compounds described in R.T. Kreiman, *J. Image. Tech* 10, No. 6, 242 (1984), isothiazoline compounds described in *Research Disclosure,* 205, No. 20526 (May, 1981), isothiazoline compounds described in ibid., 228, No. 22845 (April, 1983) and compounds described in JP-A-62-209532 may also be used in combination as microbiocides in washing tanks (or stabilizing tanks) or stock tanks.

In addition, the compounds described in Hiroshi Horiguchi, *Chemistry of Bacteria Prevention and Fungus Prevention,* published by Sankyo Shuppan (1982) and *Handbook of Bacteria Prevention and Fungus Prevention,* edited by Nippon Bohkin Bohbai Gakkai, published by Hakuhohdoh (1986) may be contained.

It goes without saying that additives to the washing water are not limited to the above.

In the present invention, a squeeze roll washing tank described in JP-A-63-18350 may be provided. It is also preferred to use the washing stage described in JP-A-63-143548.

Further, a part or the whole of an overflowed solution derived from replenishment of such washing water can also be used as a fixing solution in the preceding processing stage, as described in JP-A-60-235133.

In the present invention, the "developing time" means the time from the immersion of a leading edge of a photographic material to be processed in a developing solution until the immersion thereof in the next fixing solution. The "fixing time" means the time from the immersion in a fixing solution until the immersion in the next washing water (stabilizing solution). The "washing time" means the time for which a photographic material is immersed in washing water, and the "drying time" means the time for which a photographic material stays in a drying part.

The above-described developing time is generally from 5 to 15 seconds, and preferably from 7 to 10 seconds. The developing temperature is preferably from 18° to 50° C., and more preferably from 20° to 40° C.

The fixing time is preferably from 5 to 10 seconds at a fixing temperature of 18° to 50° C., and more preferably from 6 to 9 seconds at 30° to 40° C. Fixing can be sufficiently conducted within these ranges to allow a sensitizing dye to be eluted to such a degree that no residual coloration is produced.

The washing (stabilizing) time is preferably from 2 to 15 seconds at a washing (stabilizing) temperature of 0° to 50° C., and more preferably from 2 to 8 seconds at 15° to 40° C.

In the present invention, the photographic material which has been developed, fixed and washed is dried through a squeeze roll unit for squeezing the washing water off.

Drying methods utilizing infrared rays described in JP-A-1-206345, JP-A-1-118840, JU-A-53-156964 (the term "JU-A" as used herein means an "unexamined published Japanese utility model application"), JP-A-54-26734, JU-A-56-130937, JP-A-1-260445, JP-A-2-140741, JP-A-2-149845, JP-A-2-157754, JU-A-51-52255, and JU-A-53-53337 can also be used.

Although the drying time can be varied according to environmental conditions, drying usually requires 2 to 15 seconds, and more preferably 3 to 10 seconds at 40° to 80° C.

The photographic materials of the present invention exhibit the excellent effect that the drying time can be shortened with a reduction in the swelling rate thereof.

According to the present invention, the socalled "dry to dry" processing time until the photographic materials are developed, fixed, washed and dried is less than 45 seconds, preferably 30 seconds or less, and more preferably 25 seconds or less.

The "dry to dry" time herein means the time required from the moment a leading edge of a photographic material to be processed enters a film insertion part of an automatic processor until the moment the leading edge emerges from the automatic processor after processing.

The photographic materials of the present invention include various color materials, and black and white materials, for example, taking color negative films (e.g., for general use, for movie use), reversal color films (e.g., for slide use, for movie use, in some cases, couplers are contained or not contained), color photographic paper, color positive films (e.g., for movie use), reversal color photographic paper, color photographic materials for thermal development, color photographic materials using the silver dye bleach process, photographic materials for plate making (e.g., lith films, scanner films), X-ray photographic materials (e.g., for direct-indirect medical use, for industrial use), taking black and white negative films, black and white photographic paper, photographic materials for micro use (e.g., for COM use, microfilms), color diffusion transfer photographic materials (DTR), silver salt diffusion transfer photographic materials and printout photographic materials.

The photographic materials are preferably used in a system in which X-rays, etc., are irradiated to objects such as human bodies and X-rays which have passed through the objects are converted to visible light to expose, for example, direct taking X-ray films, indirect taking X-ray films, CRT films. Examples thereof include X-ray photographic materials for medical use or industrial use, duplicated photographic materials for X-rays and photographic materials for medical CRT images.

The present invention will be further illustrated in greater detail with reference to the following examples, which are however not to be construed as limiting the invention.

EXAMPLE 1

Preparation of Emulsions

An aqueous solution containing 4.0 g of silver nitrate and an aqueous solution containing 5.9 g of potassium bromide were added to an aqueous solution containing 6.2 g of gelatin and 6.9 g of potassium bromide per liter of water which was maintained at 49° C. by a double jet method for 37 seconds. Subsequently, an aqueous solution containing 18.6 g of gelatin was added thereto, followed by increasing the temperature to 64° C. while adding an aqueous solution containing 9.8 g of silver nitrate for 22 minutes. Further, 4.2 ml of 25% aqueous ammonia was added, and 10 minutes after that, an aqueous solution containing 3.9 g of acetic acid was also added. Subsequently, an aqueous solution containing 151 g of silver nitrate and an aqueous solution of potassium bromide were added by a control double jet method for 25 minutes while maintaining the potential at pAg 8.8. The flow rate at this time was accelerated so that the flow rate after completion of addition reached 14 times that at initiation of addition. After completion of addition, 45 ml of a 2 N thiocyanic acid solution was added. Then, the temperature of the resulting solution was lowered to 35° C. to remove soluble salts by a sedimentation method. The temperature was thereafter elevated to 40° C., and 35 g of gelatin and a thickener were added. Sodium hydroxide, potassium bromide and an aqueous solution of silver nitrate were further added to adjust the solution to pH 6.9 and pAg 7.8. After the temperature was elevated to 56° C., fine grains of AgI having a diameter of 0.07 μm were added in an amount of 0.1 mol % based on the total amount of silver, followed by addition of 198 mg of 4-hydroxy-6-methyl-1,3,3a,7-tetrazaindene and 426 mg of Dye-I described below. After 10 minutes, $0.52\times10^{-5}$ mol/mol of Ag of Selenium Compound (II-1) of the present invention, $1.03\times10^{-5}$ mol/mol of Ag of sodium thiosulfate, 30 mg of potassium thiocyanate and 6 mg of chloroauric acid were added, followed by ripening for 50 minutes. The resulting mixture was cooled rapidly and solidified to obtain Emulsion A. The emulsion thus obtained comprised grains having an aspect ratio of 3 or more in 93% of the total projected areas of all grains. For all grains having an aspect ratio of 3 or more, the mean diameter of projected areas was 0.83 μm, the mean thickness was 0.14 μm, and the mean aspect ratio was 6.2.

Emulsion B was prepared in the same manner as with Emulsion A except that Dye-I of Emulsion A was replaced with Dye (I-3) of the present invention.

Emulsion C was prepared in the same manner as with Emulsion B except that Selenium Compound (II-1) was not added and sodium thiosulfate was added in an amount of $2.06\times10^{-5}$ mol/mol of Ag.

Emulsion D was prepared in the same manner as with Emulsion A except that 4-hydroxy-6-methyl-1,3,3a,7-tetrazaindene and Dye-I were not added after addition of fine grains of AgI, but were added at 45 minutes after addition of chloroauric acid.

Emulsion E was prepared in the same manner as with Emulsion D except that Dye-I was replaced with Dye (I-3).

Dye-I

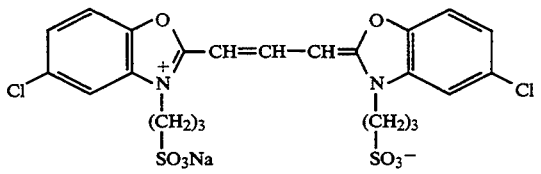

Dye (I-3)

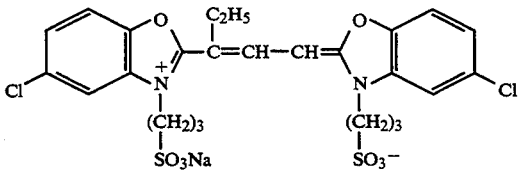

-continued

Selenium Compound (II-1)

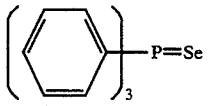

EXAMPLE 2

Preparation of Coating Solutions for Emulsion Layers

The following agents were added to chemically sensitized Emulsions A, B, C, D and E in the following amounts per mol of silver halide to prepare Coating Solutions A, B, C, D and E, respectively.

| | |
|---|---|
| 2,6-Bis(hydroxyamino)-4-diethylamino-1,3,5-triazine | 72 mg |
| Trimethylolpropane | 9 g |
| Dextran (average molecular weight: 39,000) | 18.5 g |
| Potassium Polystyrenesulfonate (average molecular weight: 600,000) | 1.8 g |
| Additive-I | 3.4 mg |
| Sodium Hydroquinonemonosulfonate | 4.8 g |
| Snowtex C (Nissan Chemical Industries, Ltd) | 29.1 g |
| Gelatin (adjusted so as to give a total amount coated on one side of 2.4 g/m$^2$) | |
| Hardener (1,2-bis(vinylsulfonylacetamide)ethane) (adjusted so as to give a swelling rate of 230%) | |

Additive-I

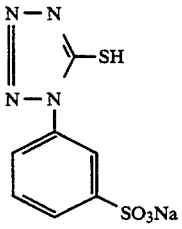

Preparation of Coating Solution for Surface Protective Layer

Coating Solution a-1 was prepared so as to have the following amounts of the respective components coated:

| | |
|---|---|
| Gelatin | 966 mg/m$^2$ |
| Sodium Polyacrylate (average molecular weight: 400,000) | 23 mg/m$^2$ |
| Coating Aid-I | 13 mg/m$^2$ |
| Coating Aid-II | 45 mg/m$^2$ |
| Coating Aid-III | 65 mg/m$^2$ |
| Coating Aid-IV | 3 mg/m$^2$ |
| Coating Aid-V | 1 mg/m$^2$ |
| Additive-II | 1.2 mg/m$^2$ |
| Polymethyl Methacrylate (mean grain size: 3.7 μm) | 87 mg/m$^2$ |
| Proxel (Adjusted to pH 7.4 with NaOH) | 0.5 mg/m$^2$ |

Coating Aid-I

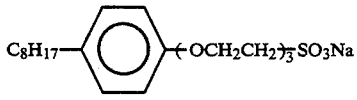

Coating Aid-II

-continued $C_{16}H_{33}O(CH_2CH_2O)_{10}H$

Coating Aid-III $C_{17}H_{33}CON(CH_3)CH_2CH_2SO_3Na$

Coating Aid-IV $C_8F_{17}SO_2N(C_3H_7)(CH_2CH_2O)_{16}H$

Coating Aid-V $C_8F_{17}SO_2N(C_3H_7)(CH_2CH_2O)_4(CH_2)_4SO_3Na$

Additive-II

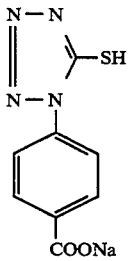

Proxel

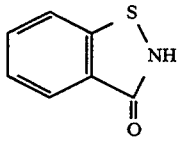

Underlayer (1) Preparation of Dyestuff Dispersion K for Underlayer

The following dyestuff was treated with a ball mill according to a process described in JP-A-63-197943.

Dyestuff-I

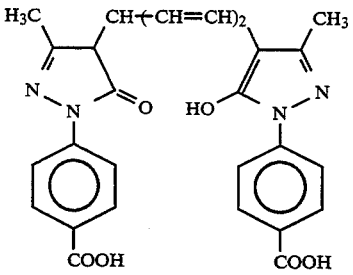

Water (434 ml) and 791 ml of a 6.7% aqueous solution of a Triton X200 (registered trade mark) surface active agent (TX-2000 (registered trade mark)) were placed in a 2-liter ball mill, and 20 g of the dyestuff was added to this solution. Zirconium oxide ($ZrO_2$) beads (2 mm in diameter) were added in an amount of 400 ml, and the contents were pulverized for 4 days. Then, 160 g of 12.5% gelatin was added thereto. After defoaming, the $ZrO_2$ beads were removed by filtration. Observation of the resulting dyestuff dispersion revealed that the grain size of the pulverized dyestuff was 0.37 μm.

Centrifugation was further conducted to remove dyestuff grains having a size of 0.9 μm or more.

Thus, Dyestuff Dispersion K was obtained.

(2) Preparation of Support and Formation of Underlayer

A 183 μm-thick biaxially oriented polyethylene terephthalate film was subjected to corona discharge, and one surface thereof was coated with a first undercoating solution having the-following composition with a wire bar coater so as to give an amount coated of 5.1 ml/m², followed by drying at 175° C. for 1 minutes, thus forming a first underlayer.

| | |
|---|---|
| Butadiene-styrene Copolymer Latex Solution* (solid content: 40%, butadiene/styrene ratio by weight = 31/35) | 79 ml |
| 4% Aqueous Solution of 2,4-Dichloro-6-hydroxy-s-triazine Sodium Salt | 20.5 ml |
| Distilled Water | 900.5 ml |

*In the latex solution, the following emulsifying dispersing agent was used in an amount of 0.4% by weight based on the latex solid.

Emulsifying Dispersing Agent $(n)C_6H_{13}OOCCH_2$
$(n)C_6H_{13}OOCCH(SO_3Na)$

Then, the first underlayer was similarly formed on the opposite side of the film.

The polyethylene terephthalate film used contained 0.04% by weight of a dyestuff having the following structure:

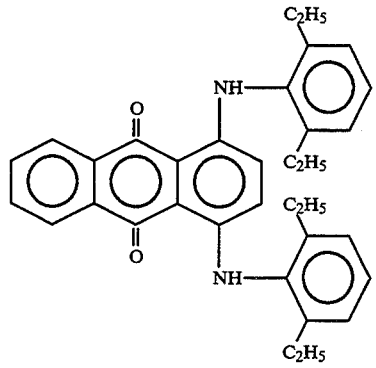

The above-described first underlayers on both surfaces were coated with a second undercoating solution having the following composition at 150° C. by the wire bar coater system, surface by surface, so as to give the following amounts coated, and dried, thus forming second underlayers.

| | |
|---|---|
| Gelatin | 160 mg/m² |
| Dyestuff Dispersion K (as the dyestuff solid) | 26 mg/m² |
| Coating Aid-VI | 8 mg/m² |
| Proxel | 0.27 mg/m² |
| Matting Agent (polymethyl methacrylate having a mean grain size of 2.5 μm) | 2.5 mg/m² |

Coating Aid-VI

-continued

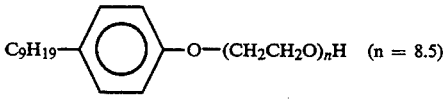

Preparation of Photographic Materials

Both surfaces of the support prepared as described above were coated with the emulsion for the emulsion layer and the coating solution for the surface protective layer which had been prepared above in combination as shown in Table 1, by a simultaneous extrusion process. The amount of silver coated per surface was 1.75 g/m$^2$. Thus, Samples 1 to 5 were obtained.

TABLE 1

| Sample | Emulsion for Emulsion Layer | Coating Solution for Surface Protective Layer |
|---|---|---|
| 1 | A | a-1 |
| 2 | B | a-1 |
| 3 | C | a-1 |
| 4 | D | a-1 |
| 5 | E | a-1 |

Processing

Automatic Processor

CEPROS-M manufactured by Fuji Photo Film Co., Ltd. was used.

A drive motor and a gear unit were converted to increase the transferring speed.

| Concentrate of Developing Solution | |
|---|---|
| Potassium Hydroxide | 56.6 g |
| Sodium Sulfite | 200 g |
| Diethylenetriaminepentaacetic Acid | 6.7 g |
| Potassium Carbonate | 16.7 g |
| Boric Acid | 10 g |
| Hydroquinone | 83.3 g |
| Diethylene Glycol | 40 g |
| 4-Hydroxymentyl-4-methyl-1-phenyl-3-pyrazolidone | 22 g |
| 5-Methylbenzotriazole | 2 g |
| Processing Aid-I | 0.6 g |
| Water to make | 1 liter |

Processing Aid-I

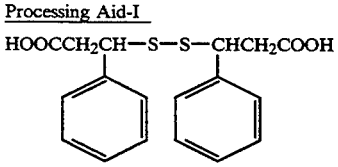

| Concentrate of Fixing Solution | |
|---|---|
| Ammonium Thiosulfate | 560 g |
| Sodium Sulfite | 60 g |
| Disodium Ethylenediaminetetraacetate Dihydrate | 0.1 g |
| Sodium Hydroxide | 24 g |
| Water to make | 1 liter |
| (The pH was adjusted to 5.10 with acetic acid.) | |

When processing was started, respective tanks of the automatic processor were filled with the following processing solutions:

Developing Tank: The above-described concentrate of the developing solution (333 ml), water (667 ml) and a starter (10 ml) containing 2 g of potassium bromide and 1.8 g of acetic acid were added, and the pH was adjusted to 10.25.

Fixing Tank: The above-described concentrate of the fixing solution (200 ml) and water (800 ml) were added.

Processing Speed: Adjusted so as to give a specified "dry to dry" time.

| | |
|---|---|
| Developing Temperature: | 35° C. |
| Fixing Temperature: | 32° C. |
| Drying Temperature: | 45° C. |
| Replenishment Rate: | Developing solution; 22 ml/10 × 12 in.<br>Fixing Solution; 30 ml/10 × 12 in. |

Evaluation of Photographic Characteristics

Both surfaces of the photographic material were exposed for 0.05 second using an X-ray orthoscreen, HR-4, manufactured by Fuji Photo Film Co., Ltd. After exposure, the above-described processing was conducted to evaluate sensitivity. The sensitivity was indicated by the reciprocal of a ratio of the exposure giving a density of 1.0 in addition to fogging, on the basis of Sample 1. Results are shown in Table 2. After processing, the residual coloration (the transmission optical density of a non-image part measured with green light) was evaluated, and results thereof are also shown in Table 2.

TABLE 2

| Sample | Sensitivity | Residual Coloration | Identity |
|---|---|---|---|
| 1 | 100 | 0.083 | Comparison |
| 2 | 110 | 0.025 | Invention |
| 3 | 105 | 0.021 | Invention |
| 4 | 103 | 0.078 | Comparison |
| 5 | 108 | 0.019 | Invention |

The results shown in Table 2 reveal that the emulsions containing the compounds of the present invention are high in sensitivity and in reduced residual coloration.

EXAMPLE 3

Preparation of Coating Solutions for Emulsion Layers

Coating Solutions for Emulsion Layers

The following agents were added to chemically sensitized Emulsions A to E in the following amounts per mol of silver halide to prepare Coating Solutions A to E, respectively.

| | |
|---|---|
| 2,6-Bis(hydroxyamino)-4-diethylamino-1,3,5-triazine | 72.0 mg |
| Dextran (average molecular weight: 39,000) | 3.9 g |
| Potassium Polystyrenesulfonate (average molecular weight: 600,000) | 0.7 g |
| Additive-I | 7.0 mg |
| Sodium Hydroquinonemonosulfonate | 8.2 g |
| Snowtex C (Nissan Chemical Industries, Ltd) | 10.5 g |
| Ethyl Acrylate/Methacrylic Acid (97/3) Copolymer Latex | 9.7 g |
| Gelatin (adjusted so as to be contained in an emulsion layer in an amount coated of 2.6 g/m$^2$) | |
| Hardener (1,2-bis(vinylsulfonylacetamide)ethane) (adjusted so as to give a swelling rate of 230%) | |

Preparation of Coating Solution for Surface Protective Layer

Coating Solution b-1 was prepared so as to have the following amounts of the respective components coated:

| | |
|---|---|
| Gelatin | 650 mg/m$^2$ |
| Sodium Polyacrylate (average molecular weight: 400,000) | 18 mg/m$^2$ |
| Butyl Acrylate/Methacrylic Acid (4/6) Copolymer Latex (average molecular weight: 120,000) | 50 mg/m$^2$ |
| Coating Aid-I | 18 mg/m$^2$ |
| Coating Aid-II | 45 mg/m$^2$ |
| Coating Aid-IV | 0.9 mg/m$^2$ |
| Coating Aid-V | 0.61 mg/m$^2$ |
| Coating Aid-VII | 26 mg/m$^2$ |
| Additive-II | 1.3 mg/m$^2$ |
| Polymethyl Methacrylate (mean grain size: 2.5 μm) | 87 mg/m$^2$ |
| Proxel | 0.5 mg/m$^2$ |
| Potassium Polystyrenesulfonate (average molecular weight: 600,000) (Adjusted to pH 7.4 with NaOH) | 0.9 mg/m$^2$ |

Coating Aid-VII

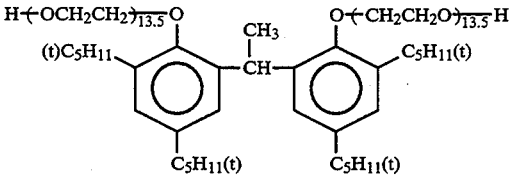

Preparation of Coating Solution for Back Surface Antihalation Layer (1) Preparation of Dyestuff Dispersion L In 50 cc of ethyl acetate, 2.5 g portions of Dyestuff-II, Oil-1 and Oil-2 shown below were dissolved. The solution was mixed with 90 g of an 8% aqueous solution of gelatin containing 1.5 g of sodium dodecylbenzenesulfonate and 0.18 g of methyl p-hydroxybenzoate at 60° C., and the mixture was stirred with a homogenizer at high speed. After completion of high-speed stirring, treatment under reduced pressure was carried out at 60° C. by use of an evaporator to remove 92% by weight of the ethyl acetate, thereby obtaining Dyestuff Dispersion L having a mean grain size of 0.18 μm.

Dyestuff-II

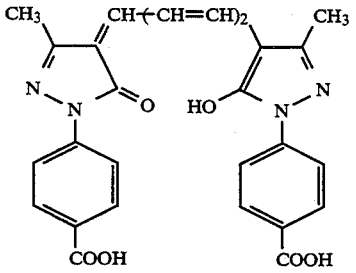

(2) Preparation of Coating Solution

A coating solution was prepared so as to have the following amounts of the respective components coated:

| | |
|---|---|
| Gelatin | 2.0 g/m$^2$ |
| Phosphoric Acid | 5.2 mg/m$^2$ |
| Snowtex C (Nissan Chemical Industries, Ltd) | 0.5 g/m$^2$ |
| Ethyl Acrylate/Methacrylic Acid (97/3) Copolymer Latex | 0.5 g/m$^2$ |
| Proxel | 4.2 mg/m$^2$ |
| Dyestuff Dispersion L | 8.0 g/m$^2$ |
| Dyestuff-III | 75 mg/m$^2$ |
| Dyestuff-IV | 50 mg/m$^2$ |
| Dyestuff-V | 50 mg/m$^2$ |
| Hardener (1,2-bis(vinylsulfonyl-acetamide)ethane) | 40 mg/m$^2$ |

Dyestuff-III

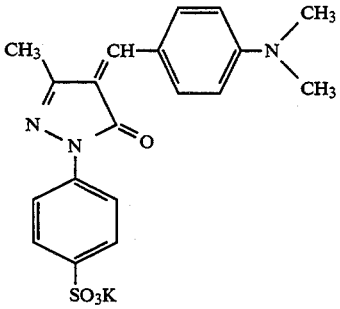

Dyestuff-IV

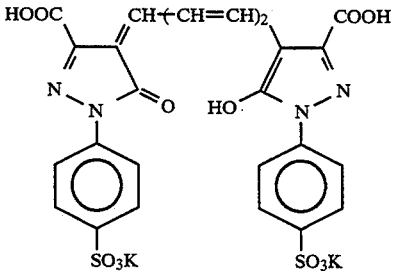

Dyestuff-V

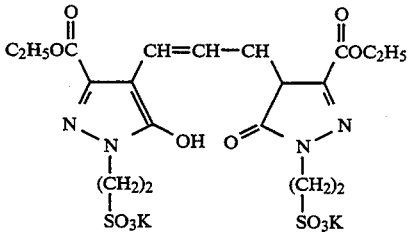

Oil-I

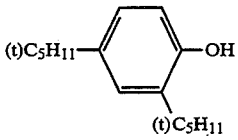

Oil-II

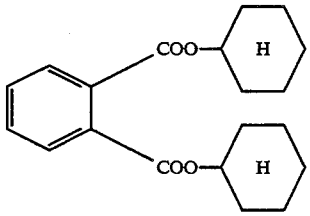

Surface Protective Layer

A coating solution was prepared so as to have the following amounts of the respective components coated:

| | |
|---|---|
| Gelatin | 1000 mg/m$^2$ |
| Polymethyl Methacrylate | |
| (mean grain size: 3.5 μm) | 20 mg/m$^2$ |
| (mean grain size: 0.75 μm) | 81 mg/m$^2$ |
| Coating Aid-I | 20 mg/m$^2$ |
| Coating Aid-II | 40 mg/m$^2$ |
| Coating Aid-IV | 6 mg/m$^2$ |
| Coating Aid-V | 9 mg/m$^2$ |
| Coating Aid-VIII | 1.7 mg/m$^2$ |
| Coating Aid-IX | 13 mg/m$^2$ |
| Proxel | 1.3 mg/m$^2$ |
| Potassium Polystyrenesulfonate (average molecular weight: 600,000) | 2 mg/m$^2$ |
| NaOH | 2.5 mg/m$^2$ |

Coating Aid-VIII
$C_8F_{17}SO_3K$

Coating Aid-IX

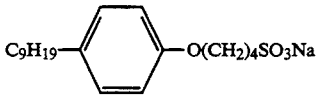

Preparation of Support

A support was prepared in the same manner as with Example 2 until the first underlayers were formed.

Preparation of Photographic Materials

One surface of the support prepared as described above was coated with the coating solution for the back surface antihalation layer and the coating solution for the protective layer. Then, the opposite surface was coated with the emulsion for the emulsion layer and the coating solution for the surface protective layer in combination as shown in Table 3 by a simultaneous extrusion process. The amount of silver coated of the emulsion layer was 2.7 g/m$^2$. Thus, Samples 6 to 10 were obtained.

TABLE 3

| Sample | Emulsion for Emulsion Layer | Coating Solution for Surface Protective Layer |
|---|---|---|
| 6 | A | b-1 |
| 7 | B | b-1 |
| 8 | C | b-1 |
| 9 | D | b-1 |
| 10 | E | b-1 |

Evaluation of Photographic Characteristics

Allowing a CRT for a medical multicamera (illuminant: P-45) to emit light so as to have a density gradient, the photographic materials were exposed from the emulsion layer side for 1 second, and then, processed in the same manner as with Example 2 to evaluate sensitivity. The sensitivity was indicated by the reciprocal of a ratio of the exposure giving a density of 1.0 in addition to fogging, on the basis of Sample 6. Results thereof are shown in Table 4. The residual coloration was evaluated in the same manner as with Example 2, and results thereof are also shown in Table 4.

TABLE 4

| Sample | Sensitivity | Residual Coloration | Indentity |
|---|---|---|---|
| 6 | 100 | 0.092 | Comparison |
| 7 | 125 | 0.038 | Invention |
| 8 | 118 | 0.025 | Invention |
| 9 | 107 | 0.039 | Comparison |
| 10 | 115 | 0.021 | Invention |

The results shown in Table 4 reveal that the emulsions containing the compounds of the present invention are high in sensitivity and reduced in residual coloration.

According to the present invention, the silver halide photographic materials reduced in residual coloration caused by color sensitizing agents and high in sensitivity can be obtained.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support and at least one silver halide emulsion layer formed thereon, in which light-sensitive silver halide grains contained in the silver halide emulsion layer have been selenium sensitized, and the silver halide emulsion layer comprises at least one compound represented by the following formula (I):

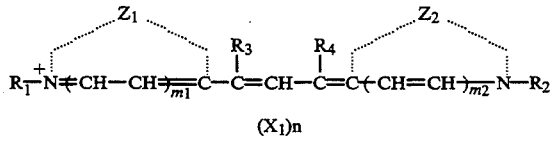

(I)

wherein $Z_1$ and $Z_2$ each represents a non-metallic atom or atoms necessary for forming a benzoxazole nucleus;

$R_1$ and $R_2$, which may be the same or different, each represents an alkyl group;

$R_3$ and $R_4$ each represents a hydrogen atom or an unsubstituted alkyl group having from 1 to 4 carbon atoms, and at least one of $R_3$ and $R_4$ is an unsubstituted alkyl group having from 1 to 4 carbon atoms;

$X_1$ represents an ion pair sufficient to neutralize the charge of the compound;

$m_1$ and $m_2$ each represents 0 or 1; and n represents 0 or 1, and n is 0 when an internal salt is formed.

2. The silver halide photographic material as in claim 1, wherein the grains have been sensitized with at least one selenium sensitizer represented by the following formula (II) and spectrally sensitized with at least one sensitizing dye represented by formula (I):

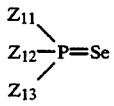

(II)

wherein $Z_{11}$, $Z_{12}$ and $Z_{13}$, which may be the same or different, each represents an alkyl group, an aryl group, a heterocyclic group, a halogen atom, a hydrogen atom, $—OR_{11}$, $—NR_{12}(R_{13})$, $—SR_{14}$ or $—SeR_{15}$;

wherein $R_{11}$, $R_{14}$ and $R_{15}$ each represents an alkyl group, an aryl group, a heterocyclic group, a hydrogen atom or a cation; and $R_{12}$ and $R_{13}$ each represents an alkyl group, an aryl group, a heterocyclic group, or a hydrogen atom.

3. The silver halide photographic material as in claim 1, wherein the alkyl group represented by $R_1$ or $R_2$ is selected from the group consisting of a methyl group, an ethyl group, a 2-sulfoethyl group, a 3-sulfopropyl group, a 4-sulfobutyl group and a 3-sulfobutyl group.

4. The silver halide photographic material as in claim 2, wherein the selenium sensitizer according to formula (II) is selected from the group consisting of a trialkylphosphine selenide, a triarylphosphine selenide, a trialkyl selenophosphate and a triaryl selenophosphate.

5. The silver halide photographic material as in claim 1, wherein the light-sensitive silver halide grains contained in the silver halide emulsion layer have been selenium sensitized by a selenium sensitizer which is present in an amount of from $10^{-8}$ to $10^{-4}$ mol per mol of silver halide.

* * * * *